United States Patent [19]

Kodama

[11] Patent Number: 4,462,364

[45] Date of Patent: Jul. 31, 1984

[54] HYDRAULIC LASH ADJUSTER

[75] Inventor: Hisashi Kodama, Nagoya, Japan

[73] Assignee: Aisin Seiki Kabushiki Kaisha, Kariya, Japan

[21] Appl. No.: 425,775

[22] Filed: Sep. 28, 1982

[30] Foreign Application Priority Data

Sep. 30, 1981 [JP] Japan ..... 56-145645[U]

[51] Int. Cl.[3] ..... F01L 1/34

[52] U.S. Cl. ..... 123/90.55; 123/90.52; 123/90.46

[58] Field of Search ..... 123/90.52, 90.54, 90.55, 123/90.56, 90.57, 90.48, 90.46

[56] References Cited

U.S. PATENT DOCUMENTS

| | | | |
|---|---|---|---|
| 2,812,750 | 11/1957 | Lesher | 123/90.57 |
| 2,941,523 | 6/1960 | Bergmann | 123/90.57 |
| 3,079,903 | 3/1963 | Humphreys | 123/90.59 |
| 3,476,093 | 11/1969 | Line | 123/90.55 |
| 4,347,812 | 9/1982 | Kosuda et al. | 123/90.55 |

*Primary Examiner*—Ira S. Lazarus
*Assistant Examiner*—R. S. Bailey
*Attorney, Agent, or Firm*—Sughrue, Mion, Zinn, Macpeak and Seas

[57] ABSTRACT

An hydraulic lash adjuster is provided with a hollow cylindrical body having a closed bottom at one end thereof and a hollow cylindrical plunger having an apertured bottom at one end thereof slidably disposed within the body to define a reservoir chamber within said plunger and a pressure chamber between the bottom of said cylinder. A spring biased check valve is located within said pressure chamber in operative association with the apertured bottom of said plunger to control the flow of fluid from the reservoir chamber to the pressure chamber. A cup-shaped cap is provided at the outer end of the plunger for engagement with a push rod of a valve mechanism and is provided with a passage communicating the interior of the plunger with the exterior. An annular valve seat ring is slidably disposed within the plunger to divide the reservoir into an upper chamber adjacent the cup-shaped cap and a lower chamber adjacent the bottom of the plunger and the second check valve located in the lower reservoir chamber is spring biased into engagement with the valve seat for controlling the flow of fluid from the upper reservoir chamber to the lower reservoir chamber. First and second annular grooves are formed in the outer surface of the body and the plunger and a port is located in the bottom of each groove with the ports and grooves being located relative to each other for the passage of a fluid from the outside of said body to the upper reservoir chamber.

4 Claims, 4 Drawing Figures

HYDRAULIC LASH ADJUSTER

BACKGROUND OF THE INVENTION

The present invention relates to hydraulic lash adjusters and more particularly to a hydraulic lash adjuster adapted to be used in the valve train of an internal combustion engine.

In the valve trains of internal combustion engines, predetermined valve clearances are generally provided in order to compensate for thermal expansion of various parts in the valve trains. However, since excessive lash may be generated due to valve clearances in the valve trains during engine operation, hydraulic lash adjusters have been used for automatically taking up the valve clearances in valve trains to thereby prevent undesirable noises.

Conventional lash adjusters include a plunger slidably arranged within a body to define a reservoir chamber therein, a pressure chamber to which a pressure receiving surface of the plunger is exposed and a check valve which will allow the flow of a fluid, such as oil, from the reservoir chamber to the pressure chamber. The reservoir chamber receives the fluid from an external source outside the body by means of a port provided in the plunger and a supply port provided in the body. In order to ensure the transmission of fluid from outside of the body to the reservoir chamber without undesirable problems regarding alignment of the ports, the body is usually provided with annular grooves 142 and 42' as shown in the prior art example of FIG. 4 which face the plunger and the engine block, respectively, and which are in communication with the supply port 44' extending through the body. However, the body must have a predetermined thickness throughout its entire length, even at the portion thereof at which the annular grooves 142 and 42' are located in order to provide sufficient strength for the body. In other words, the thickness of the remaining portions of the body must be unnecessarily increased in order to provide sufficient thickness in the vicinity of the grooves and therefore the weight of the body is substantially increased. Since the body undergoes vigorous reciprocating motion it is undesirable to have such an increase in the weight of the body.

SUMMARY OF THE INVENTION

The present invention provides a new and improved hydraulic lash adjuster which obviates the drawbacks of the prior art lash adjuster described above.

The present invention provides a new and improved hydraulic lash adjuster which is light in weight while still providing the necessary strength. The lash adjuster according to the present invention is comprised of a hollow cylindrical body closed at one end, a hollow cylindrical plunger having an apertured bottom slidably disposed in said body with leakage clearance to define a reservoir chamber therein and a pressure chamber between the bottom of said plunger and the bottom of said body, valve means controlling communication between said chambers through said apertured bottom of said plunger, port means extending through said body and said plunger for admitting fluid from an external source to said reservoir chamber and first and second annular grooves formed about the external surfaces of said body and said plunger with said ports located in the bottom of each of said grooves.

The foregoing and other objects, features and advantages of the present invention will be apparent from the following more particular description of a preferred embodiment of the invention as illustrated in the accompanying drawings.

DETAILED DESCRIPTION OF THE INVENTION

Figure 1:
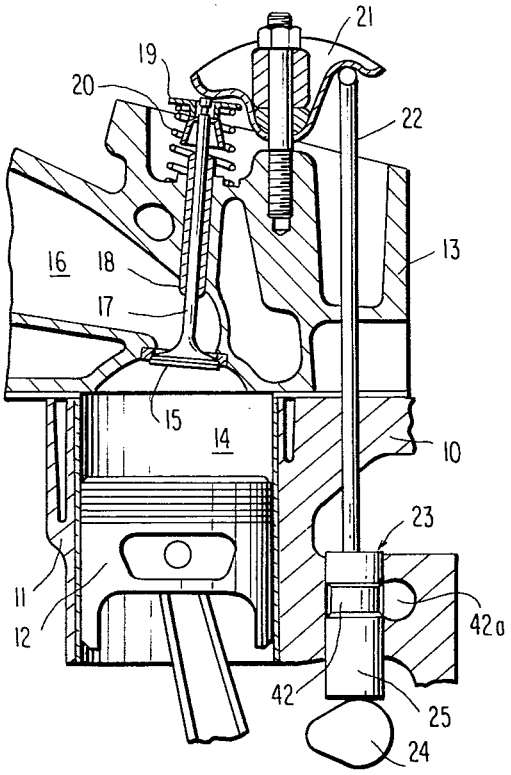
FIG. 1 is a sectional view through a portion of an internal combustion engine having the valve operating mechanism incorporating a hydraulic lash adjuster constructed in accordance with the present invention.

The valve operating mechanism as shown in FIG. 1 includes a cylinder block 10 of an internal combustion engine having a cylinder 11, a piston 12 slidably disposed within said cylinder and a cylinder head 13 defining a combustion chamber 14 with said piston and cylinder. The chamber 14 is in communication with a port 16 by means of a valve 15. The stem 17 of the valve 15 is slidably positioned within a guide 18 and is provided with a retainer 19 at the upper end thereof. The retainer 19 receives one end of a spring 20 the other end of which is seated against the cylinder head 13. The spring 20 biases the valve 15 into the closed position as shown in FIG. 1. The upper end of the valve stem 17 is brought into contact with one end of a rocker arm 21. The other end of the rocker arm 21 is disposed in engagement with a push rod 22 the lower end of which is operatively associated with a lash adjuster 23 according to the present invention. The lower end of the lash adjuster 23 is disposed in engagement with a cam 24. The valve 15 is opened by the rotation of the cam 24 through the lash adjuster 23, push rod 22 and rocker arm 21. The hydraulic lash adjuster 23 is shown in greater detail in FIG. 2 and includes a hollow cylindrical body 25 having a closed bottom at one end and a hollow cylindrical plunger 26 having an apertured bottom slidably disposed within the body 25 to define a reservoir chamber 40 within the plunger 26 and a pressure chamber 39 between the apertured bottom of the plunger 26 and the bottom of the body 25. The upper open end of the plunger 26 receives a cup 27 having a concave spherical surface which in turn is adapted to receive a convex spherical end portion of the push rod 22. The plunger 26 is biased upwardly by a spring 29 which is inserted between a cup-shaped retainer 28 and the bottom of the body 25. The apertured bottom of the plunger 26 is provided with a passage 30 which provides for fluid communication between the reservoir and pressure chambers 40 and 39. The ball check valve 31 is located within the cup-shaped retainer 28 and is biased into engagement with a valve seat **31*a* surrounding the passage 30 by means of a spring 32 disposed between the ball valve 31 and the retainer 28**.

An annular valve seat 33 is pressed into the plunger 26 to define a chamber 41. The seat 33 is comprised of a metal ring 34 and an annular cover 35 of rubber or the like. A check valve member 36 is located within the reservoir chamber 40 and is provided with four circumferentially extending legs 37 to define a retainer arrangement for one end of the spring 38, the other end of which bears against the bottom of the plunger 26 for biasing the valve member 36 into engagement with a cover 35 of the valve seat 33.

Figure 2:
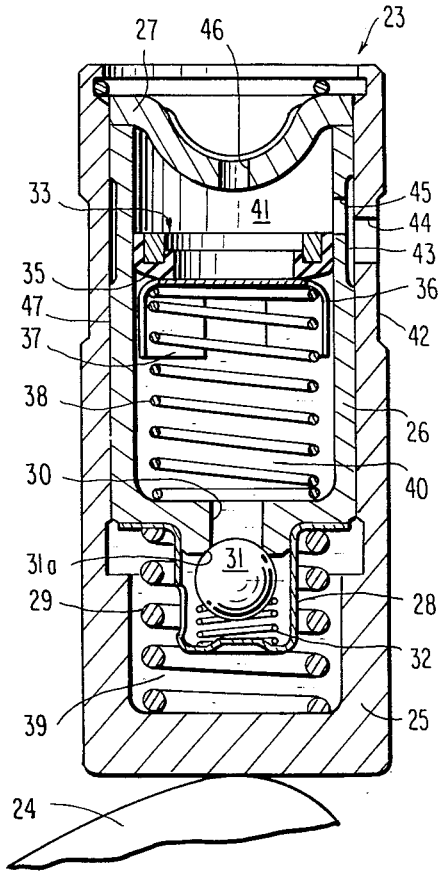
FIG. 2 is an enlarged sectional view of the lash adjuster in FIG. 1 showing the internal parts thereof in detail.
Figure 3:
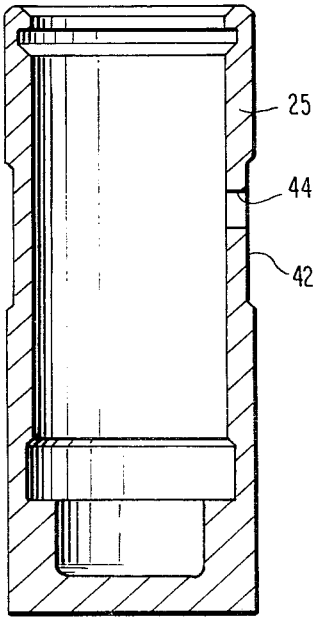
FIG. 3 is a sectional view of the body only of the lash adjuster shown in FIG. 2.

The body 25 is provided with a shallow annular groove 32 on the outer surface thereof and a port 44 which is in communication with the bottom of the groove 42 as best seen in FIGS. 2 and 3. The plunger 26 is also provided on the outer surface thereof with a shallow annular groove 43 and a port 45 which is in communication with the bottom of the groove 43 and the chamber 41. The groove 43 has sufficient axial extent so as to maintain the groove in communication with the port 44 in the body at all times during the reciprocation of the plunger 26 within the body 25. Thus, constant communication will be provided between the grooves 42, 43 and the ports 44, 45 at all times. After assembling of the hydraulic lash adjuster within the engine block 10, the groove 42 in the body 25 is positioned so as to be in communication with a passage 42*a* in the engine block 10 as shown in FIG. 1. The passage 42*a* is connected to a pressurized fluid source such as the outlet of an oil pump (not shown).

The chamber 41 is disposed in fluid communication with the reservoir chamber 40 through the opening in the annular valve seat 33 under the control of the valve member 36 and is also disposed in communication with the outside by means of a hole 46 provided in the bottom of the cup 27.

In operation, when the engine is not operating and the lash adjuster is in engagement with the lift portion of the cam 24, the plunger 26 is urged downwardly by means of the spring 20 associated with the retainer 19 on the valve stem 17 by means of the rocker arm 21 and the push rod 22. Therefore, fluid such as oil within the pressure chamber 29 will flow out of the adjuster through the leakage clearance 47 between the plunger 26 and the body 25. When the engine is not operating both check valves 31 and 36 are closed as shown in FIG. 2. Thus, even when the engine is inclined and installed as a V-type engine and even when the lash adjuster 23 is inclined, the fluid within the reservoir 40 is maintained. Under the above conditions, the lash adjuster receives no fluid from the passage 42*a*.

When the engine is started, the cam shaft 24 is rotated and the body 25 is moved downwardly. The push rod 22 is now under substantially no load and the plunger 26 is moved upwardly by means of the spring 29. As a result, the pressure of the fluid within the chamber 39 will be reduced and a check valve 31 will be opened to allow the flow of fluid from the reservoir chamber 40 into the pressure chamber 39. At this time the reservoir 40 will receive fluid from the chamber 41 under the control of the check valve 36. The fluid which the reservoir chamber 40 receives from the chamber 41 is proportional to the fluid which is transmitted from the reservoir chamber 40 into the pressure chamber 39. During the operation of the engine the chamber 41 receives pressurized oil from the oil pump through the passage 42*a*, groove 42, port 44, groove 43 and port 45 so that no air is introduced into the reservoir chamber 40.

When the cam shaft 24 is further rotated the body 25 is moved upwardly and the load which is applied on the push rod 22 by the spring 20 is increased. Thus, the pressure of the fluid within the chamber 39 is increased and a check valve 31 is brought into contact with the valve seat 31*a*. At this time oil is transmitted from the pressure chamber 39 into the reservoir chamber 40 by means of the leakage clearance 47. As a result, the plunger 26 is moved downwardly with respect to body 25 by a distance $\alpha$. When the cam shaft 24 is further rotated the body 25 is moved downwardly and the load which is applied on the push rod 22 by the spring 20 will be reduced to substantially 0. Thus, the plunger 26 is moved upwardly with respect to the body 25 by the distance $\alpha$. As a result, the pressure of the oil within the pressure chamber 39 will be reduced and the check valve 31 will separate from the valve seat 31*a*. Oil will then be transmitted from the reservoir chamber 40 to the pressure chamber 39 and the lash adjuster will be returned to its original position. The foregoing operation is repeated continuously during the operation of the invention.

The above distance $\alpha$ of expansion and contraction will depend on the viscosity of the oil which must flow through the leakage clearance 47 and the viscosity of the oil will change in response to changes in temperature. Thus, the distance $\alpha$ will be changed in response to changes in temperature.

If a clearance is produced in the valve operating mechanism due to thermal expansion of the cylinder block, cylinder head, or the like, the plunger 26 will be moved upwardly by the return spring 29 with respect to the body 25 in order that the clearance will become 0. On the other hand, when the valve operating mechanism is lengthened by a distance $\beta$, the plunger 26 is moved upwardly by a distance $(\alpha\text{-}\beta)$ by spring 29 from its condition in which plunger 26 is contracted by $\alpha$ so that the clearance will become 0.

Figure 4:
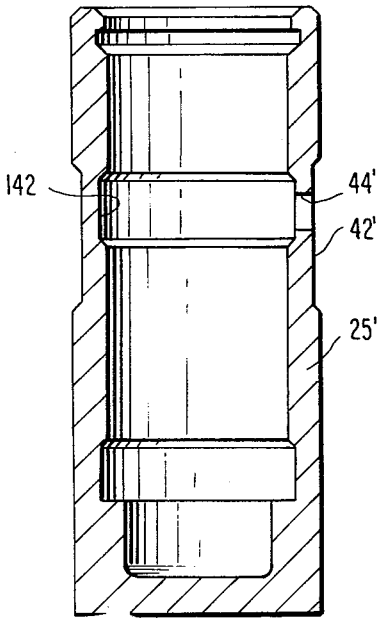
FIG. 4 PRIOR ART
FIG. 4 is a view similar to FIG. 3 showing the body of a prior art lash adjuster.

By providing the body 25 with an outer annular groove 42 but with no annular groove opposed thereto on the inner surface thereof, the wall thickness of the body 25 can be reduced, except in the vicinity of the groove, as compared with the thickness of the body 25' as shown in the prior art arrangement of FIG. 4. This enables a substantial reduction in the weight of the body and eliminates the cutting operation by the groove on the inner surface of the body.

While the invention has been particularly described and shown with reference to the preferred embodiment thereof it will be understood by those familiar in the art that the various changes in form and details may be made therein without departing from the spirit and scope of the invention.

What is claimed is:

1. A hydraulic lash adjuster comprising a hollow cylindrical body having a bottom at one end thereof, a hollow cylindrical plunger having an apertured bottom slidingly disposed in said body with leakage clearance therebetween defining a reservoir chamber within said plunger and a pressure chamber between the bottom of said plunger and the bottom of said body, first check valve means operatively associated with the apertured bottom of said plunger for controlling the flow of fluid from said reservoir chamber to said pressure chamber, cup means operatively associated with one end of said plunger for operative engagement with the push rod in a valve mechanism, first and second annular grooves located in the outer surface of the said body and said plunger respectfully, first and second port means located in the bottom of each of said grooves with said grooves and ports being operatively associated with each other for supplying a fluid through said body and said plunger to said reservoir chamber, annular valve seat means disposed in said plunger between said port in said plunger and the bottom of said plunger and second check valve means associated with said valve seat means on the side thereof towards the bottom of said plunger for controlling the flow of fluid from said port in said plunger to said reservoir chamber.

2. A hydraulic lash adjuster as set forth in claim 1 wherein said cup means is provided with a concave outwardly facing recess and a passage in the bottom of said concave recess for communicating the interior of said plunger with the exterior.

3. A hydraulic lash adjuster as set forth in claim 1 wherein said second check valve means is comprised of a circular disc having a plurality of axially extending legs spaced about the circumference thereof to define a spring retainer and a spring disposed in said reservoir chamber between said spring retainer and the bottom of said plunger.

4. A hydraulic lash adjuster as set forth in claim 1 wherein said annular valve seat means is pressed into said plunger to define said reservoir chamber and an outer chamber adjacent said cup means.

* * * * *